US007601036B2

(12) United States Patent
Cheng et al.

(10) Patent No.: US 7,601,036 B2
(45) Date of Patent: Oct. 13, 2009

(54) CONDUCTIVE CONTACT FOR CPU SOCKET CONNECTOR

(75) Inventors: Chih-Pi Cheng, Tu-cheng (TW); Hao-Yun Ma, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/077,114

(22) Filed: Mar. 17, 2008

(65) Prior Publication Data

US 2008/0227324 A1 Sep. 18, 2008

(51) Int. Cl.
*H01R 11/22* (2006.01)

(52) U.S. Cl. ..... 439/857

(58) Field of Classification Search ..... 439/857, 439/342, 263–269, 856
See application file for complete search history.

(56) References Cited

U.S. PATENT DOCUMENTS 5,797,774 A * 8/1998 Kaneko ..... 439/857
6,267,615 B1 7/2001 Lin
6,319,038 B1 11/2001 Howell et al.
6,478,599 B1 * 11/2002 McHugh et al. ..... 439/342
7,303,421 B2 12/2007 Liao
2003/0171040 A1 * 9/2003 Lei et al. ..... 439/752.5
2003/0199210 A1 * 10/2003 Chang ..... 439/857
2005/0048851 A1 3/2005 Okita et al.
2005/0095897 A1 5/2005 Hsu
2006/0079136 A1 * 4/2006 Wei ..... 439/700

FOREIGN PATENT DOCUMENTS

CN 2728004 Y 9/2005

* cited by examiner

*Primary Examiner*—Alexander Gilman
(74) *Attorney, Agent, or Firm*—Wei Te Chung

(57) ABSTRACT

A conductive contact (200) for electrically connecting with a chip module and a printed circuit board comprises a base portion (50), a top head portion (60) formed above the base portion adapted for connecting with a belt, at least one spring arm (70) extending sidewardly from the base portion and forming at least one contacting section (703) adapted for elastically contacting with the chip module, and a bottom soldering portion (80) extending form at least one of the base portion and the spring arm adapted for being soldered to the printed circuit board. The head portion defines a cutout (601) recessed downwardly from a top edge (602) thereof to reduce connecting length between the head portion and the belt and reduce siphonic effect when plating the spring arm.

12 Claims, 5 Drawing Sheets

200

CONDUCTIVE CONTACT FOR CPU SOCKET CONNECTOR

BACKGROUND OF THE INVENTION

1. Field of the Invention

The present invention generally relates to a conductive contact for an electrical connector, and more particularly to a conductive contact for a CPU (Central Processing Unit) socket connector.

2. Description of Related Art

Conductive contacts accommodated in a CPU socket connector for electrically connecting a CPU with a PCB (Printed circuit board) usually comprises a base, at least one arm extending from opposite sides of the base, at least one contacting section formed at free end of the at least one arm for electrically connecting with the CPU and a soldering section extending from the base for electrically connecting with the PCB. The arm comprises a stretching section and a connecting section connecting the stretching section with the contacting section. When in use, the pins of the CPU are inserted into spaces formed by the arms of the conductive contacts and contact the contacting sections of the conductive contacts to realize electrical connection among the contacts, the CPU and the PCB.

Please refer to FIGS. 1-2, a conventional conductive contact 100 comprises a base 10, a pair of arms 30 extending from opposite lateral sides of the base 10 and a soldering portion 40 located at bottom end of the base 10. The arm 30 comprises a stretching section 301 laterally and forwardly extending from the lateral side of the base 10, a connecting section 302 folded partially with the stretching section 301 and extending upwardly beyond the stretching section 301, and a contacting section 303 at a top free end of the connecting section 302. The contacting sections 303 are a function area and needs to be plated with gold to achieve reliable electrical connection with the CPU. However, since the contacting sections 303 bend from the free ends of the connecting sections 302 toward the base 10, the contacting sections 303 locate too near to the base 10. Thus, when plating gold to the contacting sections 303, the large-area base 10 absorbs gold which originally should be plated to the contacting sections 303. This causes the thicknesses of gold plated to the contacting sections 303 are not even and causes other sections except the contacting sections 303 also are plated with gold. Gold is very expensive, how to overcome this problem is a question. In addition, a top section 101 of the base 10 forms a top edge 102 connecting with a belt 1. How to separate the contacts 100 from the belt conveniently, time-consuming and of high efficiency is another problem needed to be solved. Therefore, it is desired to provide an improved conductive contact to stress the problems mentioned above.

BRIEF SUMMARY OF THE INVENTION

Accordingly, an object of the present invention is to provide a conductive contact with lower cost and high efficiency to make.

In order to achieve the above-mentioned object, a conductive contact adapted for electrically connecting with a chip module and a printed circuit board comprises a base portion, a top head portion formed above the base portion adapted for connecting with a belt, at least one spring arm extending sidewardly from the base portion and forming at least one contacting section adapted for elastically contacting with the chip module, and a bottom soldering portion extending form at least one of the base portion and the spring arm adapted for being soldered to the printed circuit board. The head portion defines a cutout recessed downwardly from a top edge thereof to reduce connecting length between the head portion and the belt and reduce siphonic effect when plating the spring arm.

Other objects, advantages and novel features of the invention will become more apparent from the following detailed description of the present embodiment when taken in conjunction with the accompanying drawings.

DETAILED DESCRIPTION OF THE INVENTION

Figure 1:
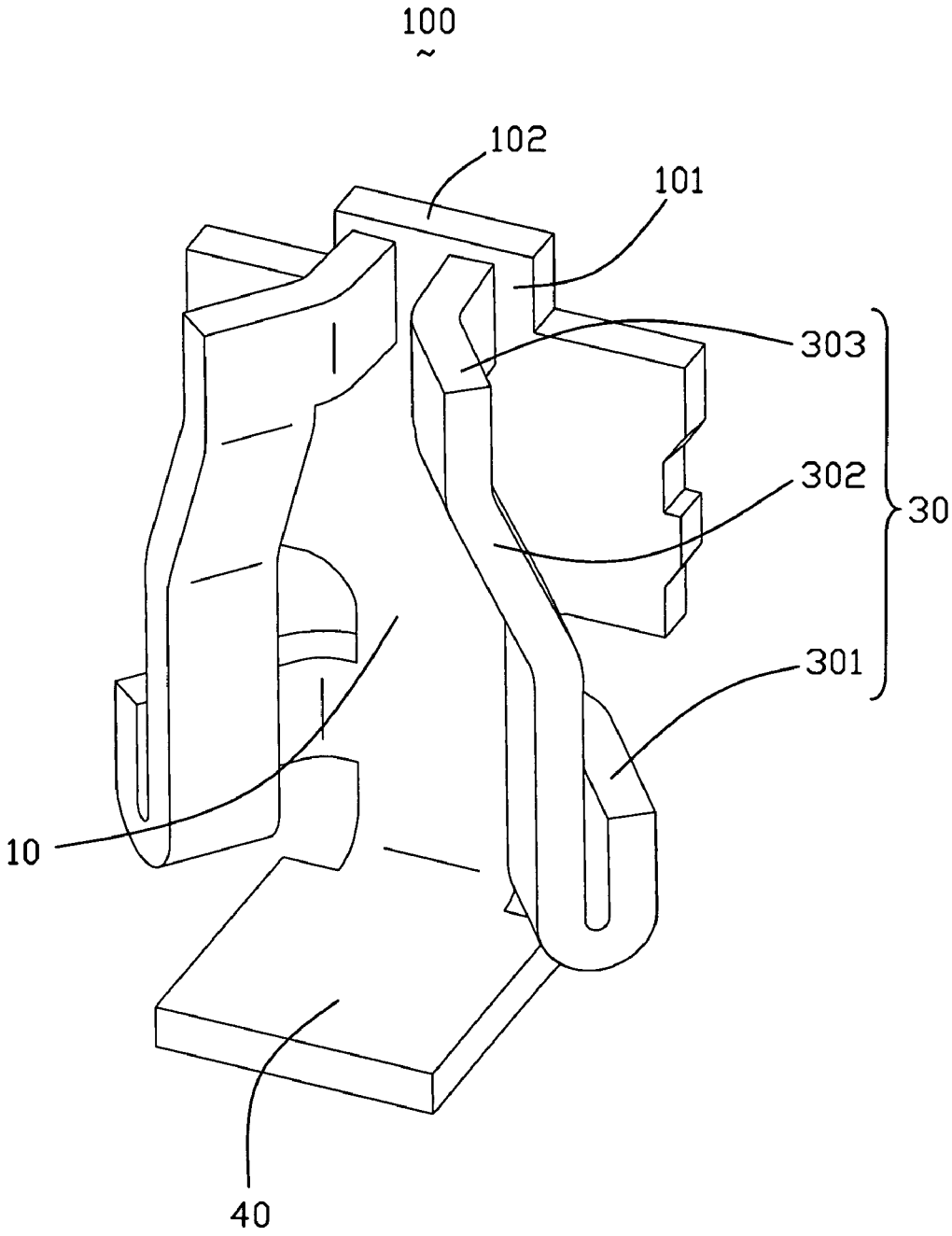
FIG. 1 is a perspective view of a conventional conductive contact.

Reference will now be made to the drawing figures to describe the present invention in detail.

Figure 2:
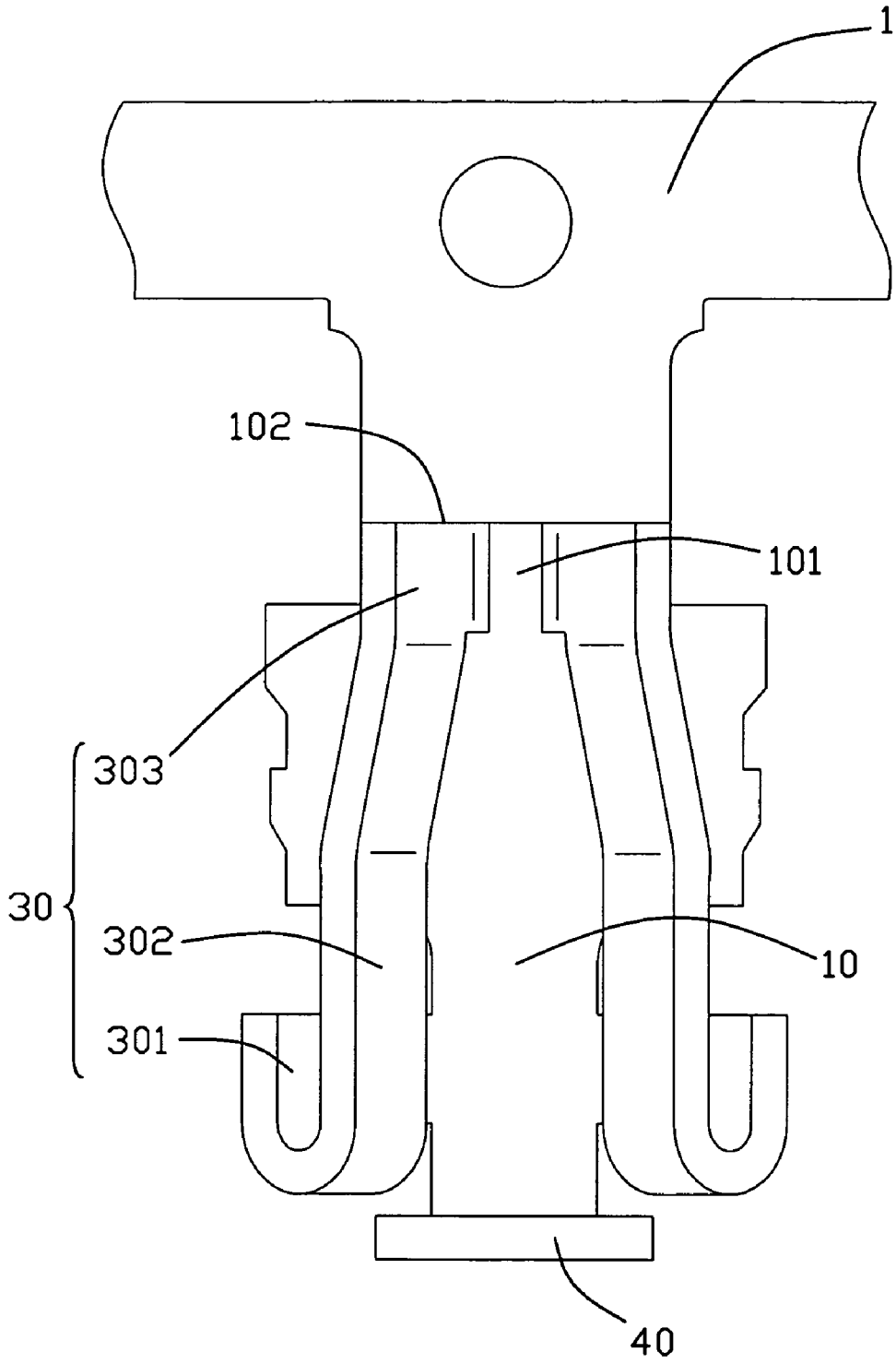
FIG. 2 is a schematic view showing the conductive contact connecting with a belt.
Figure 3:
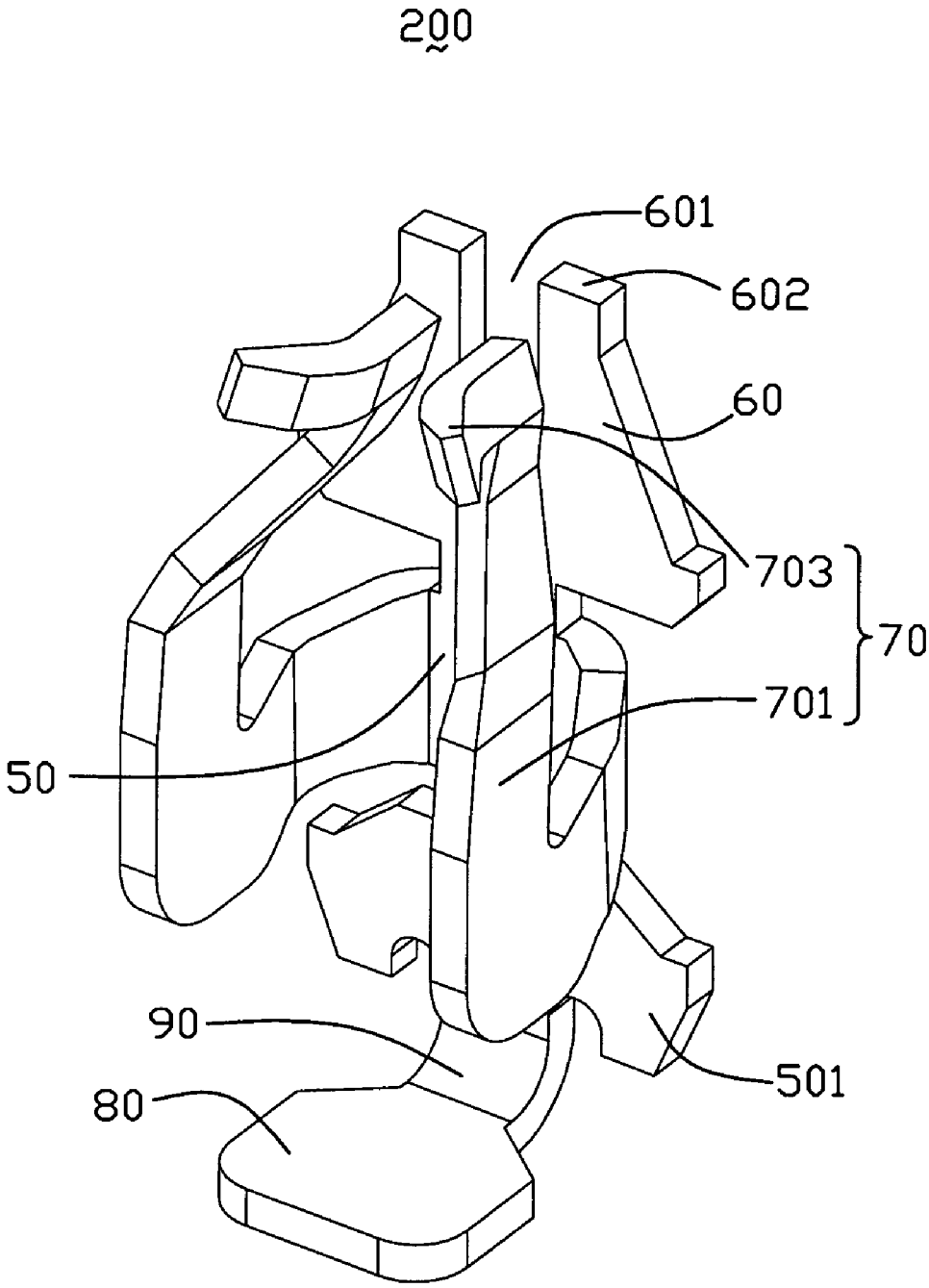
FIG. 3 a perspective view of a conductive contact in accordance with a preferred embodiment of the present invention.
Figure 4:
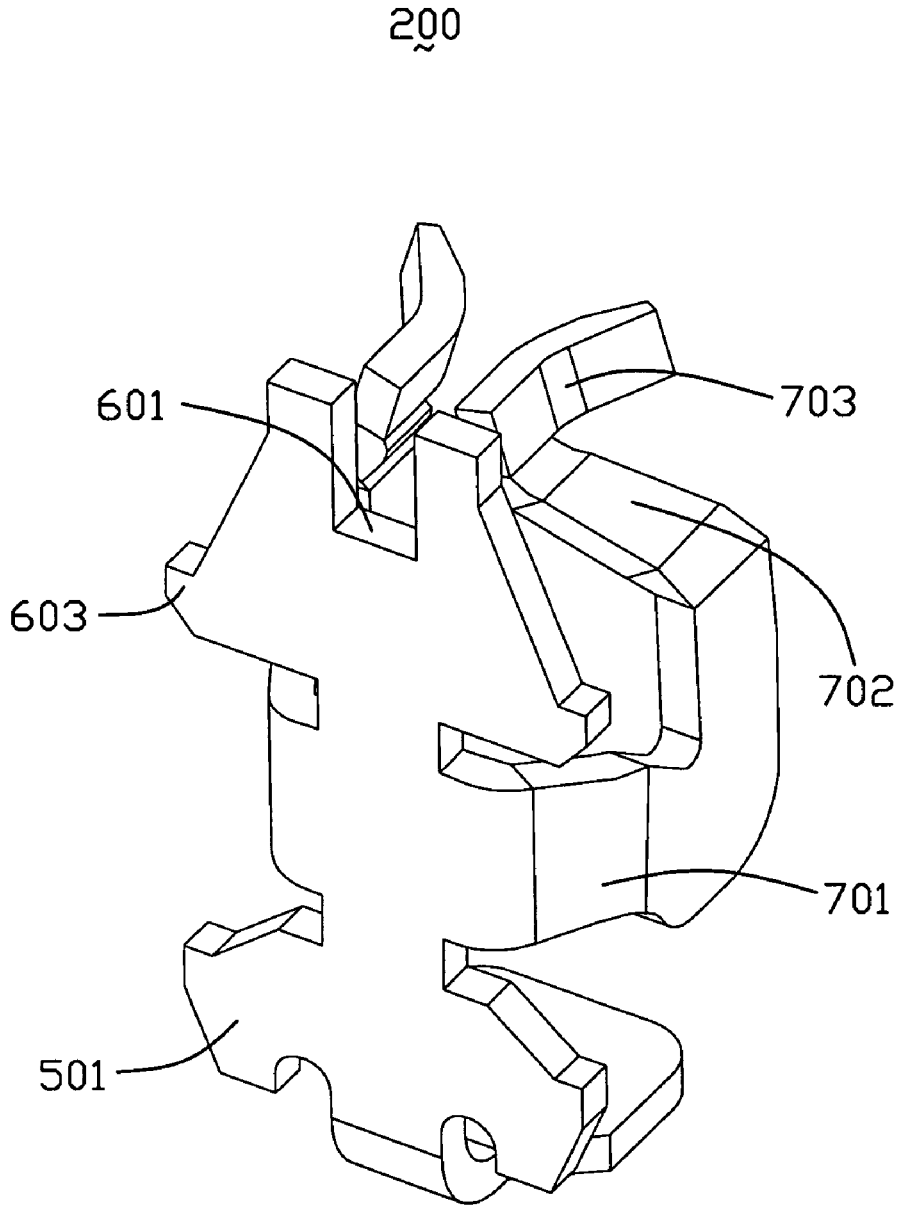
FIG. 4 is another perspective view of the conductive contact, viewed from a different aspect.
Figure 5:
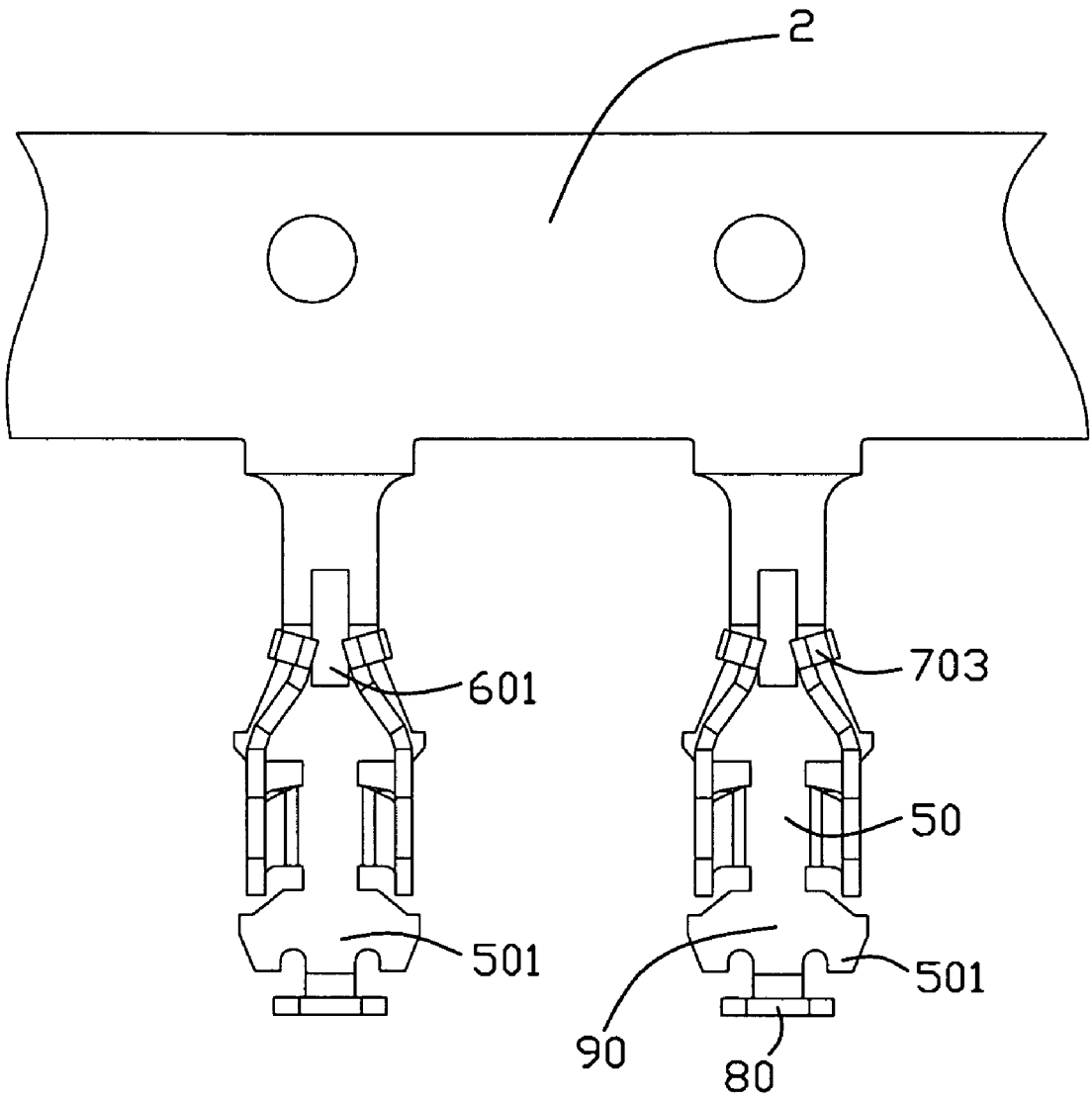
FIG. 5 is a schematic view showing a pair of conductive contacts connecting with a belt.

Please refer to FIGS. 1-5, a conductive contact 200 in accordance with the present invention is used for electrically connecting a chip module, such as a CPU (Central Processing Unit), to a PCB (Printed Circuit Board). The conductive contact 200 comprises a base 50, a head portion 60 located above the base 50 and coplanarly connected with the base 50, a pair of spring arms 70 extending forwardly from middle lateral sides of the base 50 and a bottom flat soldering portion 80 perpendicular to the base 50 and connecting with the base 50 via a curved neck 90. The soldering portion 80 is located below the pair of spring arms 70.

The head portion 60 is of trapeziform-shape and defines a U-shape cutout 601 downwardly recessed from a top edge 602 thereof, thus, the top edge 602 is divided by the cutout 601 into two sections which serve as connecting part of the conductive contact 200 with a belt 2. A plurality of barbs 603 is formed at opposite sides of a bottom edge of the head portion 60 for enhancing retention force between the conductive contact 200 with an insulative housing (not shown) of the CPU socket connector.

Each spring arm 70 comprises a substantially L-shape stretching section 701 firstly obliquely and downwardly extending from the side edge of the base 50 then upright extending, an inclined connecting section 702 bending from the stretching section 701 toward the other spring arm 70, and a curved contacting section 703 of palm shape extending along a direction away from the base 50. The pair of contacting sections 703 diverge away from each other to form a narrow space adjacent to the head portion 60 and a wide space away from the head portion 60. A plurality of barbs 501 are formed at bottom side edges of the base 50 for interferentially engaging with the insulative housing of the CPU socket connector.

The contacting sections 703 are function area of the conductive contact 200 and the pins of the CPU will firstly insert into the wide space of the contacting sections 703 then move to the narrow space to form electrical connection with the contacting sections 703. To achieve reliable electrical connection, the contacting sections 703 need to be plated with gold. When plating, the contacting sections 703 are fully plated with gold, while other sections of the conductive contact 200 also can be plated with gold with different degrees because of siphonic effect. Since the existence of the cutout 601, the surface area of the base 50 is reduced, thus, siphonic effect is greatly reduced, and the cost is reduced correspondingly. In addition, since the connecting area between the top edge 602 and the belt 2 is reduced because of the cutout 6021, the cut of the conductive contact 200 from the belt 2 is also conveniently and of higher efficiency.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A conductive contact adapted for electrically connecting with a chip module and a printed circuit board, comprising:

a base portion;

a top head portion formed above the base portion adapted for connecting with a belt;

at least one spring arm extending sidewardly from the base portion and forming at least one contacting section adapted for elastically contacting with the chip module; and a bottom soldering portion extending from at least one of the base portion and the spring arm adapted for being soldered to the printed circuit board; wherein the head portion defines a cutout recessed from a top edge thereof to reduce connecting length between the head portion and the belt and reduce siphonic effect when plating the spring arm, and the cutout extends downwardly beyond a bottom edge of the contact section.

2. The conductive contact as claimed in claim 1, wherein the at least one spring arm is a pair of spring arms forwardly from opposite side edges of the base each forming a contacting section.

3. The conductive contact as claimed in claim 2, wherein each spring arm is of L-shape and the contacting sections of the pair of spring arms facing to each other and diverging away from each other.

4. The conductive contact as claimed in claim 2, wherein the head portion and the base are located in the same plane, and wherein the soldering portion bending from a lower edge of the base to locate in a plane perpendicular to the plane of the base.

5. The conductive contact as claimed in claim 4, wherein the contacting sections of the spring arms are located in front of the head portion diverge away from each other along direction away from the head portion.

6. The conductive contact as claimed in claim 1, wherein the head portion comprises a lower edge opposite to the top edge thereof and forming a plurality of barbs adapted for interferentially received in an insulative housing of a PGA (Pin Grid Array) connector.

7. The conductive contact as claimed in claim 6, wherein the lower edge of the head portion is longer than the top edge.

8. The conductive contact as claimed in claim 1, wherein the top edge of the head portion is divided into two sections by the cutout to connecting with the belt.

9. A conductive contact, comprising:

a base;

a top head portion located above the base and defining a cutout therein;

a pair of spring arms extending away from opposite side edges of the base and each forming a contacting section at a free end thereof adapted for contacting the CPU, the pair of contacting sections facing to each other and diverging away from each other to form a narrowest space adjacent to the cutout of the head portion and a widest space away from the head portion; and a soldering portion extending from the base adapted for being soldered to the PCB; and wherein the width of the cutout is larger than the narrowest space between the contacting sections and smaller than the widest space between the contacting sections.

10. The conductive contact as claimed in claim 9, wherein the head portion is of trapeziform-shape and a top edge thereof is divided into two halves by the cutout.

11. A conductive contact comprising:

a vertical retention portion having spaced upper and lower retention areas;

a pair of contact beams extending from two lateral side edges of the retention portion and between the upper and lower areas, said contact beams defining a pair of opposite contacting sections spaced from each other with a converging space in a top view; and the upper retention area defining a downward cutout from a top edge thereof to split a distal section of said upper retention area, wherein said cutout is horizontally aligned with the converging space.

12. The conductive contact as claimed in claim 11, wherein a converging end of said space is closer to said retention portion than a diverging end of said space.

* * * * *